US008753224B1

(12) United States Patent
Kim

(10) Patent No.: US 8,753,224 B1
(45) Date of Patent: Jun. 17, 2014

(54) GOLF CLUB HEAD WITH IMPROVED AERODYNAMIC CHARACTERISTICS

(71) Applicant: Callaway Golf Company, Carlsbad, CA (US)

(72) Inventor: Wee Joung Kim, Vista, CA (US)

(73) Assignee: Callaway Golf Company, Carlsbad, CA (US)

( * ) Notice: Subject to any disclaimer, the term of this patent is extended or adjusted under 35 U.S.C. 154(b) by 15 days.

(21) Appl. No.: 13/763,403

(22) Filed: Feb. 8, 2013

(51) Int. Cl.
*A63B 53/04* (2006.01)

(52) U.S. Cl.
CPC ..... *A63B 53/0466* (2013.01)
USPC ..... 473/327; 473/345; 473/349

(58) Field of Classification Search
CPC ..... A63B 2225/01
USPC ..... 473/327, 328, 228, 345, 349; D21/759
See application file for complete search history.

(56) References Cited

U.S. PATENT DOCUMENTS 4,653,756 A * 3/1987 Sato ..... 473/327
5,203,565 A * 4/1993 Murray et al. ..... 473/242
5,318,297 A 6/1994 Davis et al.
5,435,558 A * 7/1995 Iriarte ..... 473/327
5,735,754 A 4/1998 Antonious
6,491,592 B2 * 12/2002 Cackett et al. ..... 473/342
7,390,266 B2 * 6/2008 Gwon ..... 473/228
7,658,686 B2 * 2/2010 Soracco ..... 473/342
7,713,138 B2 * 5/2010 Sato et al. ..... 473/327
2010/0009771 A1 1/2010 Newcomer
2010/0016095 A1 1/2010 Burnett et al.
2010/0016096 A1 1/2010 Burnett et al.
2010/0016097 A1 1/2010 Albertsen et al.
2010/0292020 A1 11/2010 Tavares et al.
2010/0311517 A1 12/2010 Tavares et al.
2011/0136584 A1 6/2011 Boyd et al.
2011/0281663 A1 11/2011 Stites et al.
2011/0281664 A1 11/2011 Boyd et al.
2011/0294590 A1 12/2011 Okot

* cited by examiner

*Primary Examiner* — Sebastiano Passaniti
(74) *Attorney, Agent, or Firm* — Rebecca Hanovice; Michael A. Catania; Sonia Lari

(57) ABSTRACT

A golf club head comprising a body having a crown, a sole, a face component, a heel side, a toe side, and a rear side, and an air spoiler affixed to the rear side of the body is disclosed herein. In particular, the air spoiler comprises an upper shelf that extends outwards from the crown and approximately parallel to a ground plane, and is supported by one or more ribs that extend perpendicularly from the upper shelf towards the crown. The air spoiler may be used in connection with any type of golf club head, and particularly a wood-type golf club such as a driver or fairway wood.

3 Claims, 4 Drawing Sheets

GOLF CLUB HEAD WITH IMPROVED AERODYNAMIC CHARACTERISTICS

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to designs and methods for reducing the effects of drag force when using a golf club head, and particularly a driver.

2. Description of the Related Art

Golf club designs have recently trended to include characteristics intended to increase the club's inertia values to help off-center hits go farther and straighter. Driver designs in particular have recently included larger faces, which may help the driver deliver better feeling shots as well as shots that have higher ball speeds if hit away from the face center. These recent trends can, however, be detrimental to the club's performance due to the head speed reductions that these design features introduce due to the larger geometries. The prior art generally fails to provide golf club head designs that efficiently reduce drag forces and consequentially enable the club to be swung faster along its path and contribute to an improved impact event with the golf ball.

The United States Golf Association (USGA) has increasingly limited the performance innovations of golf clubs, particularly drivers. Recently, the USGA has limited the volume, dimensions of the head, such as length, width, and height, face compliance, inertia of driver heads and overall club length. Current methods previously used to improve the performance of golf clubs have been curtailed by limitations on design parameters set by the USGA.

An area of golf club performance improvement that exists, as of this date, is the potential to reduce the drag force that opposes the club head's travel through the air during its path to the golf ball on the tee or ground. A reduction in drag force would allow the club head to travel faster along its path and contribute to an improved impact event with the golf ball, resulting in higher golf ball velocities and consequentially, in longer golf shots.

BRIEF SUMMARY OF THE INVENTION

The purpose of the present invention is to effectively incorporate design features in a golf club, and particularly a driver club head, that create lower drag coefficients as the club is swung by a golfer. The design features reduce drag forces and consequently allow the club to be swung faster than conventional club designs. The present invention increases swing speed for drivers with higher inertias, larger volumes, and robust face designs.

One aspect of the present invention is a wood-type golf club head comprising a body having a crown, a sole, a face component, a heel side, a toe side, and a rear side, and an air spoiler, wherein the air spoiler is affixed to the rear side of the body. In some embodiments, the crown and the air spoiler may each be composed of a non-metal material, and the face component and the sole may each be composed of a metal material. In some embodiments, at least one of the crown and the air spoiler may be composed of a composite material. In some embodiments, the air spoiler may comprise an upper shelf and a plurality of ribs, and the upper shelf may blend smoothly with the crown and extend towards the rear side of the body approximately parallel with a horizontal ground plane. In further embodiments, the upper shelf may be affixed to the crown and each of the plurality of ribs may extend perpendicularly from an underside of the upper shelf. In other embodiments, the plurality of ribs may comprise three ribs. In still other embodiments, each of the upper shelf and the plurality of ribs may have a thickness of no less than 0.001 inch and no more than 0.050 inch.

In some embodiments, the body may have a volume of no less than 120 cc and no more than 500 cc. In some embodiments, the air spoiler may be integrally formed with the crown, or the air spoiler may be permanently fixed to the crown with an adhesive material such as epoxy. In other embodiments, the body may be composed of a metal material selected from the group consisting of steel and titanium alloy. In still other embodiments, the air spoiler may have a mass of no more than 20 grams.

Another aspect of the present invention is a golf club head comprising a body, a face component, and an aerodynamic device, wherein the aerodynamic device is affixed to a rear portion of the body, and wherein the aerodynamic device reduces a low pressure zone behind the body. In some embodiments, the body may have a volume of no less than 400 cc and no more than 480 cc. The face component may be selected from the group consisting of a face plate, a face insert, and a face cup, and in some embodiments the aerodynamic device may comprise an upper shelf and at least one rib.

Yet another aspect of the present invention is a driver-type golf club head comprising a body having a heel side, a toe side, a rear side, a composite crown, a metal sole, a metal face component, and a volume of no more than 480 cc, and an air spoiler comprising an upper shelf and three ribs permanently affixed to the crown at a rear side of the body, wherein each of the upper shelf and the three ribs has a thickness of no less than 0.001 inch and no more than 0.050 inch, wherein the air spoiler has a mass of no more than 20 grams, and wherein the upper shelf blends smoothly with the crown and extends towards the rear side of the body approximately parallel with a horizontal ground plane. In some embodiments, the air spoiler may be affixed to the crown with epoxy. In other embodiments, the air spoiler may be composed of a material selected from the group consisting of plastic, composite, and aluminum alloy.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
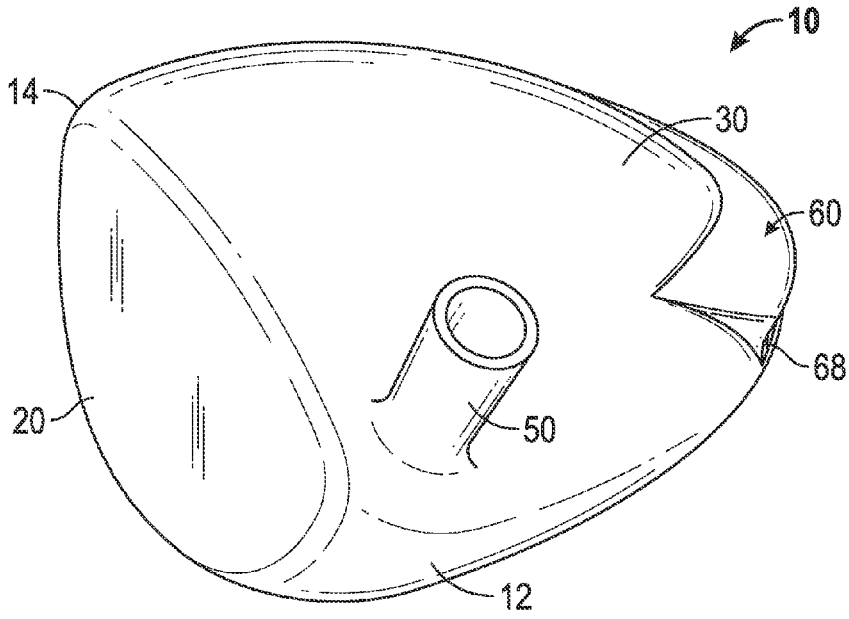
FIG. 1 is a front, side perspective view of a first embodiment of the present invention
Figure 2:
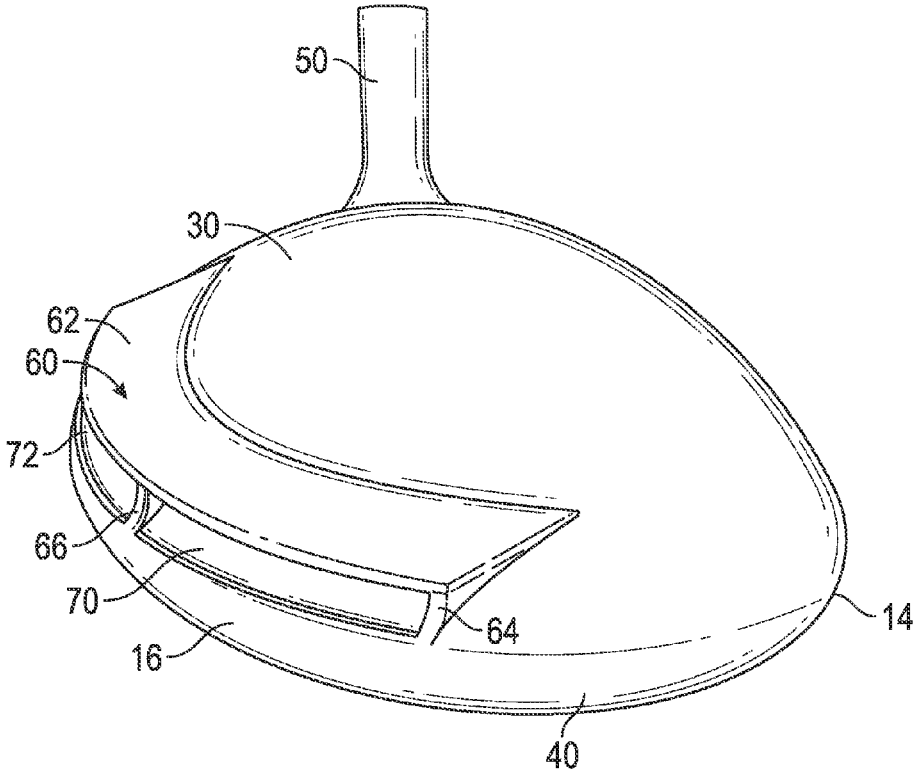
FIG. 2 is a rear, side perspective view of the embodiment shown in FIG. 1.
Figure 3:
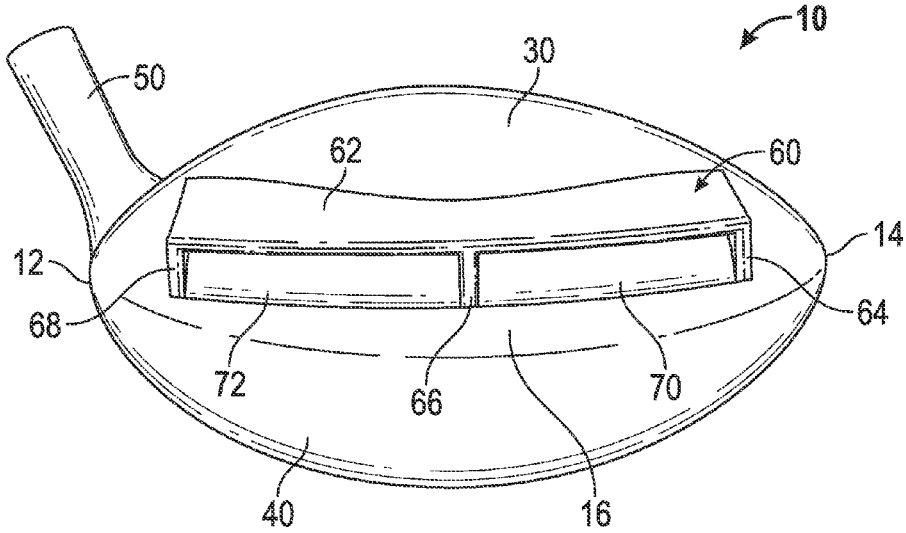
FIG. 3 is a rear perspective view of the embodiment shown in FIG. 1.
Figure 4:
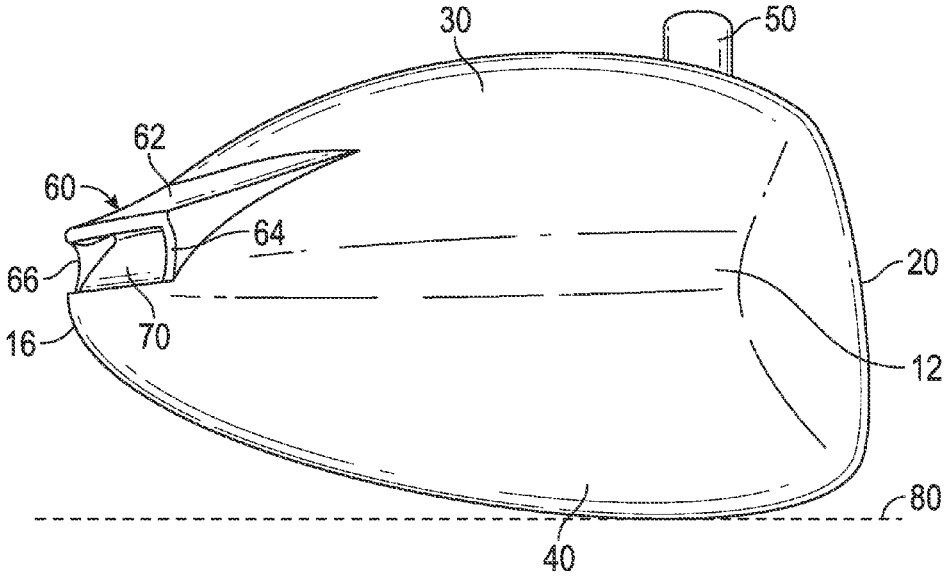
FIG. 4 is a left side perspective view of the embodiment shown in FIG. 1.
Figure 5:
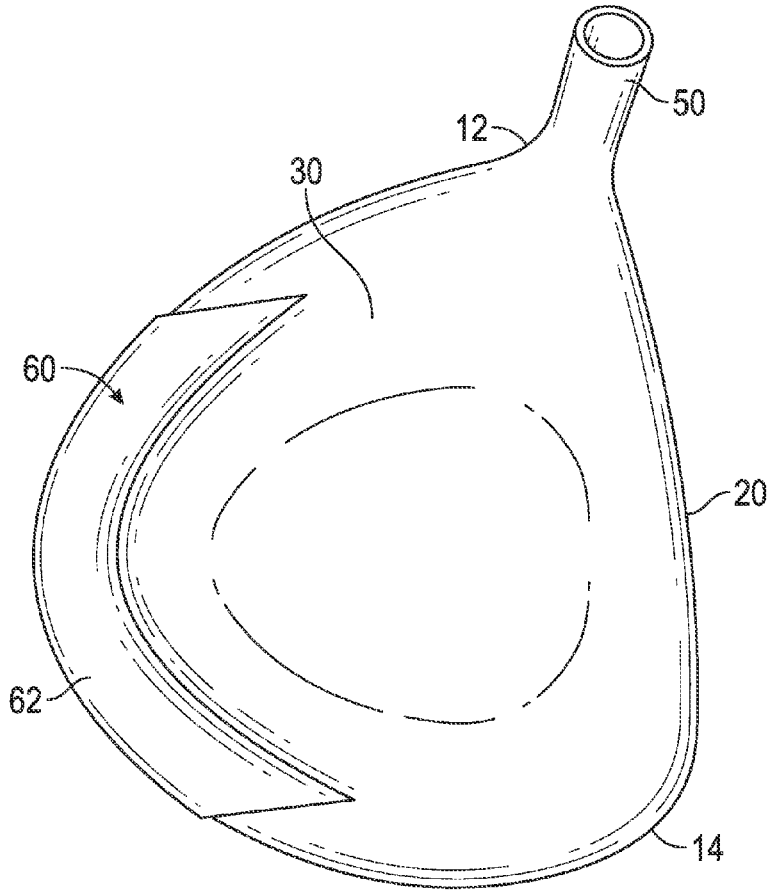
FIG. 5 is a top perspective view of the embodiment shown in FIG. 1.
Figure 6:
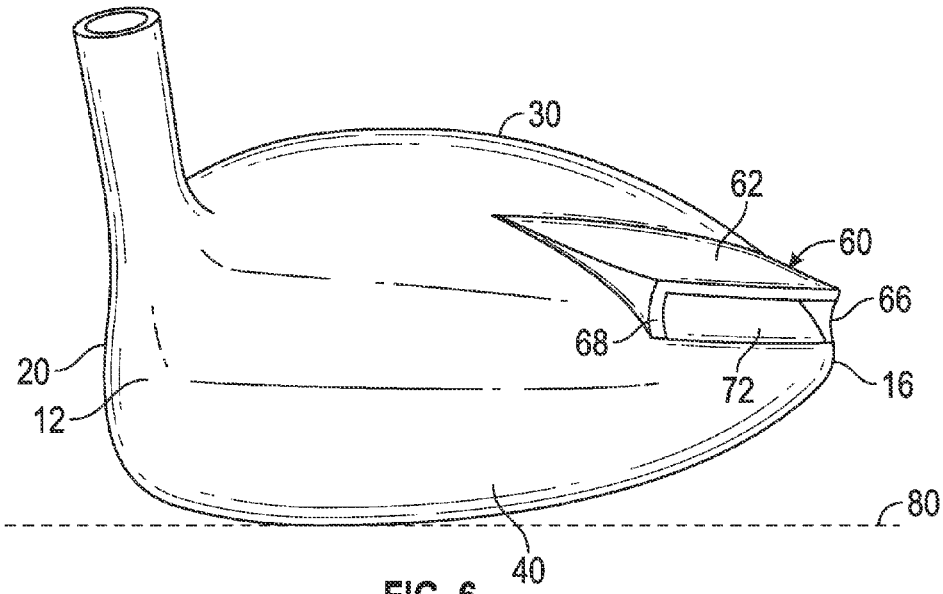
FIG. 6 is a right side perspective view of the embodiment shown in FIG. 1.

The present invention relates to a golf club head comprising a spoiler 60 that reduces drag and increases the club's swing speed. This feature may be used with any type of golf club head, and particularly a hybrid or wood-type golf club head such as a driver. This feature may also be combined with other aerodynamic features in a golf club, such as those disclosed in U.S. patent application Ser. No. 13/023,233, U.S. patent application Ser. No. 13/166,578, U.S. Pat. No. 8,241,142, and U.S. Pat. No. 8,317,636, the disclosure of each of which is hereby incorporated by reference in its entirety herein.

A preferred embodiment of the present invention is shown in FIGS. 1-6. In this embodiment, a driver-type golf club head 10 comprises a face component 20, a crown 30, and a sole 40 delineating a hollow interior, and also includes a heel side 12, a toe side 14, a rear side 16, and a hosel 50. A spoiler 60 is affixed to the rear side 16 of the golf club head 10, and comprises an upper shelf 62 and three ribs 64, 66, 68 extending perpendicularly downwards from the upper shelf 62 and connecting with the crown 30 near the junction where the crown 30 merges with the sole 40.

As shown in the Figures, the upper shelf 62 of the spoiler 60 is affixed to the crown 30 so that it smoothly blends into the crown 30 and extends outwardly, and approximately parallel with the ground plane 80, towards the rear side 16 of the golf club head 10. The ribs 64, 66, 68 provide support for the upper shelf 62 and create gaps 70, 72 between the upper shelf 62 and the crown 30, thus reducing the weight of the spoiler 60 and the overall weight of the golf club head 10. The upper shelf 62 of the spoiler 60 preferably has a thickness of 0.001-0.100 inch, while the ribs 64, 66, 68 preferably each have a thickness of 0.001-0.050 inch. The spoiler 60 preferably has an overall mass of no more than 20 grams, and more preferably between 10 and 15 grams.

Figure 7:
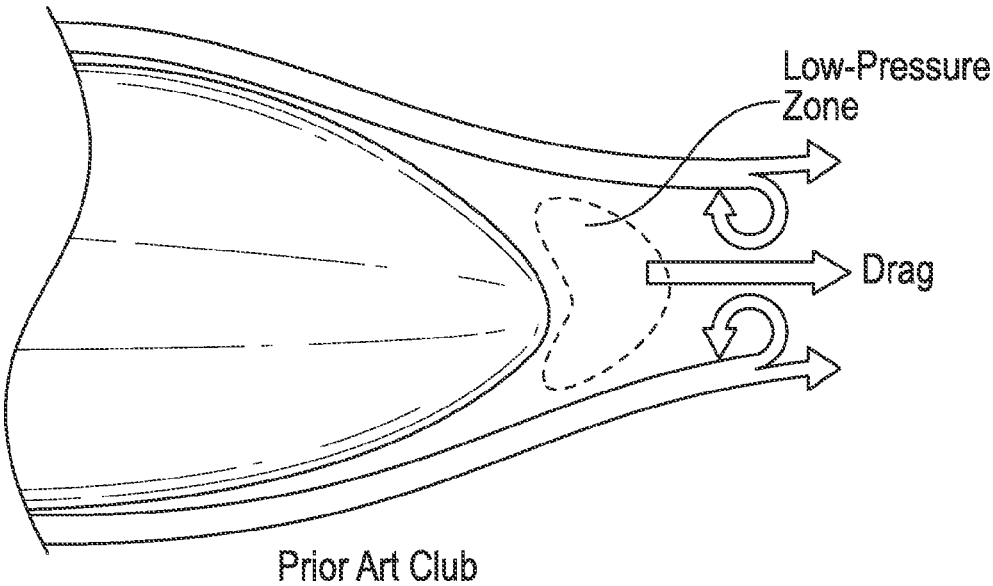
FIG. 7 is an illustration of drag created by a prior art golf club head compared with drag created by the embodiment shown in FIG. 1.
Figure 7:
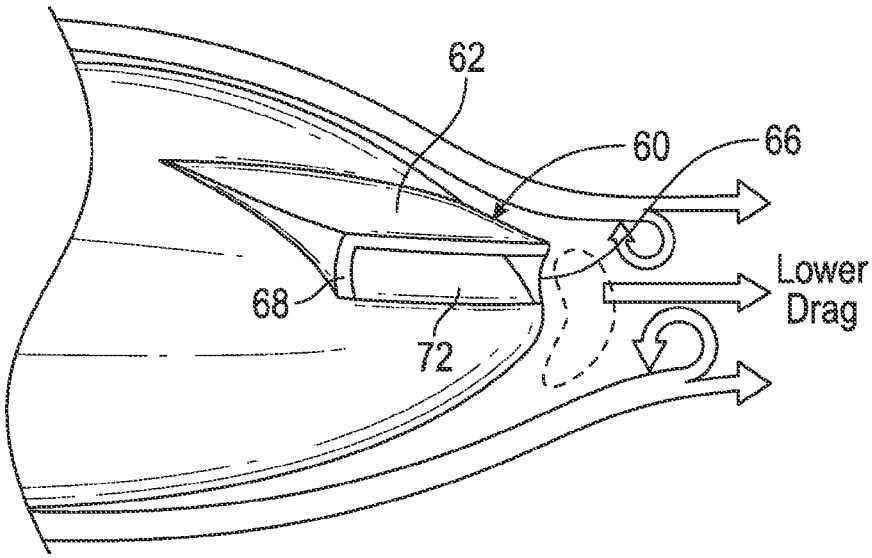

As shown in FIG. 7, a low pressure zone forms behind a traditional, driver-type golf club head when it is swung, and causes significant drag that slows down the overall swing speed. The spoiler 60 shrinks the low pressure zone, reduces the drag created when air flows over the crown 30 and sole 40 during a swing, and thus increases the swing speed and stability of the golf club head 10 during a swing. Computational Fluid Dynamics (CFD) analysis has shown that as the airflow moves from the face 20 onto the crown 30 and sole 40 surfaces of the club head 10, it may accelerate and can promote negative drag on the transitional surfaces. This desirable negative drag can be achieved by including the spoiler 60 described herein.

The golf club head 10 of the preferred embodiment preferably has a multi-material configuration, with a composite crown 30 and a metal face component 20 and sole 40, which preferably are integrally formed. The spoiler 60 is preferably composed of a lightweight, non-metal material such as plastic or composite, though in other embodiments it may be composed of a lightweight metal such as aluminum alloy. The spoiler 60 preferably is permanently affixed to the crown 30 at the rear side 16 of the club head 10 with an adhesive such as epoxy, though in alternative embodiments the spoiler 60 may be removably affixed to the club head 10 with a removable adhesive or mechanical fasteners.

The golf club head 10 of the present invention may be made of one or more materials, may include variable face thickness technology, and may have one or more of the structural features described in U.S. Pat. No. 7,163,468, U.S. Pat. No. 7,163,470, U.S. Pat. No. 7,166,038, U.S. Pat. No. 7,214,143, U.S. Pat. No. 7,252,600, U.S. Pat. No. 7,258,626, U.S. Pat. No. 7,258,631. U.S. Pat. No. 7,273,419, and U.S. Pat. No. 7,410,428, the disclosure of each of which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A driver-type golf club head comprising:

a body having a heel side, a toe side, a rear side, a composite crown, a metal sole, a metal face component, and a volume of no more than 480 cc; and an air spoiler comprising an upper shelf and three ribs permanently affixed to the crown at a rear side of the body, wherein each of the upper shelf and the three ribs has a thickness of no less than 0.001 inch and no more than 0.050 inch, wherein the air spoiler has a mass of no more than 20 grams, and wherein the upper shelf blends smoothly with the crown and extends towards the rear side of the body approximately parallel with a horizontal ground plane.

2. The driver-type golf club head of claim 1 wherein the air spoiler is affixed to the crown with epoxy.

3. The driver-type golf club head of claim 1, wherein the air spoiler is composed of a material selected from the group consisting of plastic, composite, and aluminum alloy.

* * * * *